US006095353A

United States Patent [19]

Gargiulo et al.

[11] Patent Number: 6,095,353

[45] Date of Patent: Aug. 1, 2000

[54] SLIDE LOCK CHILD RESISTANT SAFETY CAP

[75] Inventors: Vincent Gargiulo, New York; William Gargiulo, Merrick, both of N.Y.

[73] Assignee: Christopher Tarantino, New York, N.Y.

[21] Appl. No.: 09/209,844

[22] Filed: Dec. 11, 1998

[51] Int. Cl.[7] ..... B65D 50/06; B65D 55/02

[52] U.S. Cl. ..... 215/204; 215/221; 215/277

[58] Field of Search ..... 215/203, 204, 215/217–221, 223, 228, 230, 236, 322, 277, 278, 330; 220/315, 345.1, 345.2

[56] References Cited

U.S. PATENT DOCUMENTS

| | | | |
|---|---|---|---|
| 3,311,247 | 3/1967 | Rigor | 215/221 X |
| 3,394,829 | 7/1968 | Peterson . | |
| 3,794,200 | 2/1974 | Marks . | |
| 4,337,869 | 7/1982 | Guinle . | |
| 4,690,292 | 9/1987 | Henning | 215/219 X |
| 4,787,525 | 11/1988 | Joyce . | |
| 4,998,632 | 3/1991 | Morris, Sr. . | |
| 5,147,053 | 9/1992 | Friedenthal . | |
| 5,170,900 | 12/1992 | Manera | 215/221 X |
| 5,344,035 | 9/1994 | Manera | 215/219 |
| 5,509,550 | 4/1996 | DeJonge | 215/204 |
| 5,769,252 | 6/1998 | Volpe | 215/221 |
| 5,893,473 | 4/1999 | Morris, Sr. | 215/219 X |

FOREIGN PATENT DOCUMENTS

| | | | |
|---|---|---|---|
| 2422949 | 3/1976 | Germany | 215/221 |
| 2142612 | 1/1985 | United Kingdom | 215/204 |

*Primary Examiner*—Nathan J. Newhouse

*Attorney, Agent, or Firm*—Levisohn, Lerner, Berger & Langsam

[57] ABSTRACT

A safety cap, having an inner cap for covering a container and an outer cap covering the inner cap for selectively rendering the inner cap child resistant, is provided. The inventive safety cap includes a fixing mechanism for selectively fixing the inner and outer caps together, the fixing mechanism being preferably movable from a first position to a second position. When the fixing mechanism is in the first position, the outer cap is rotationally fixed with respect to the inner cap, and when the fixing mechanism is in the second position, the outer cap is rotationally independent of the inner cap. Thus, when the fixing mechanism is in the first position, the inventive cap functions like a conventional non-safety cap. When the fixing mechanism is moved into its second position, the outer and inner caps are made rotationally independent, and thus the cap of the invention functions like a safety cap requiring simultaneous downward force and twisting to remove. The fixing mechanism is preferably made to be irreversibly child-resistant and not returnable to the first position once moved into the second position.

19 Claims, 2 Drawing Sheets

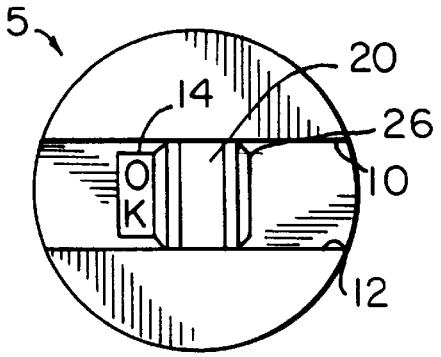
FIG.1A
FIG.1B
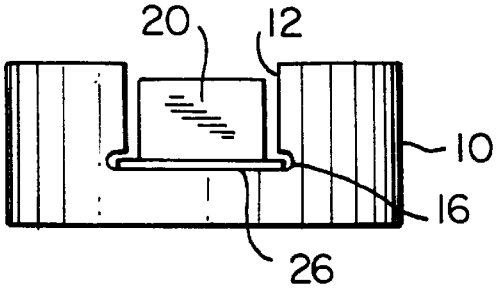
FIG. 6
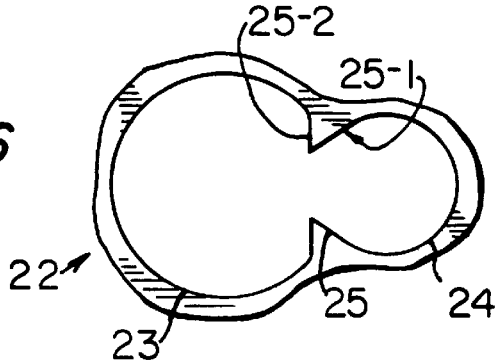
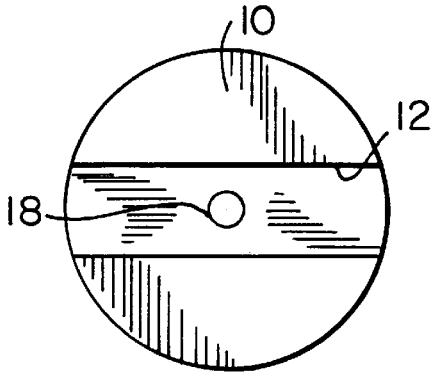
FIG.2A
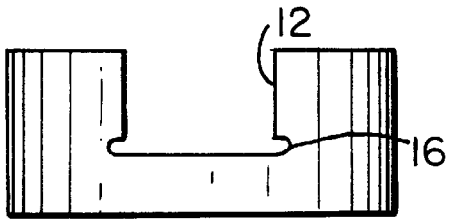
FIG.2B
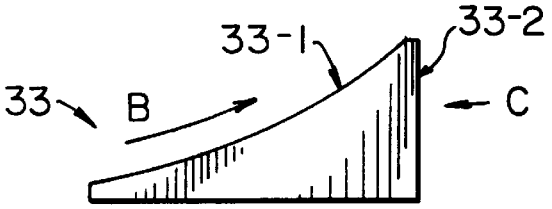
FIG. 7

FIG.3A
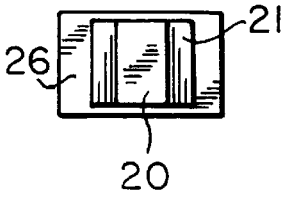
FIG.3B
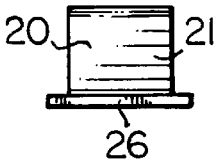
FIG.3C
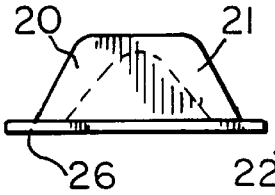
FIG.3D
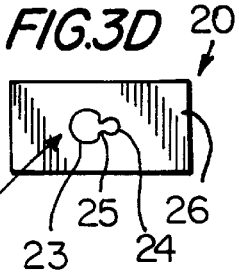
FIG.4A
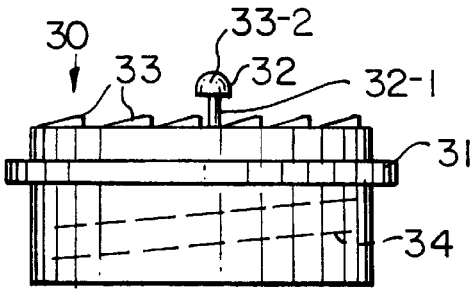
FIG.4B
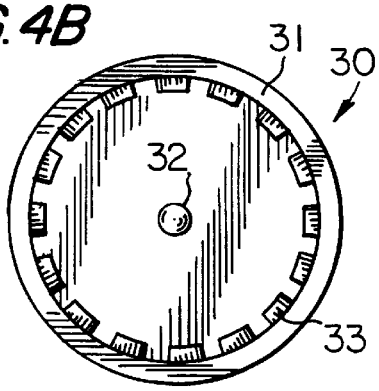
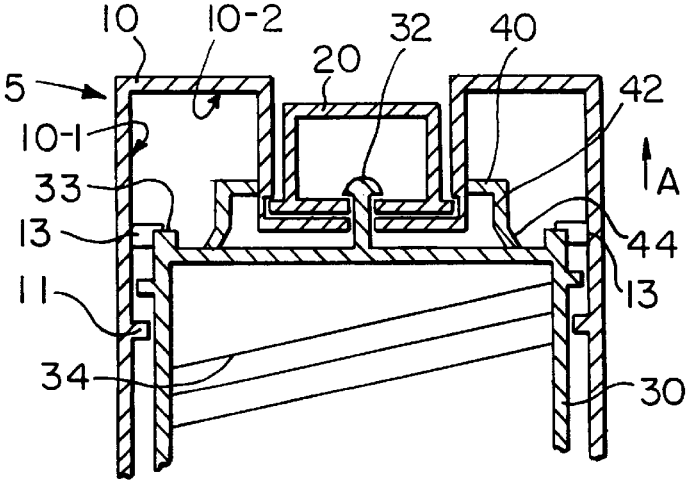
FIG.5

SLIDE LOCK CHILD RESISTANT SAFETY CAP

BACKGROUND OF THE INVENTION

1. Field of the Invention

The invention relates to caps for medicine containers and the like. More particularly, the invention relates to safety caps which are child-resistant.

2. Description of the Related Art

Safety caps for medicine containers, over-the-counter pharmacological products, and the like, are known. Many medicines and pills are extremely dangerous if taken in overdoses; young children have a tendency to experiment with medication, mistaking it for candy. Also, while a child who gains unauthorized access to medication may not actually ingest it, in many cases, accessed medication is wasted or unusable (e.g., poured down a sink), a needless expense to the purchaser of the medication.

One typical safety cap constitutes a two-piece design. The inner piece is threaded and engages threads on the container. The outer piece covers the inner piece and prevents easy opening of the container. An example of such a conventional safety cap can be found in U.S. Pat. No. 3,394,829 to Peterson, the teachings of which are incorporated by reference herein. Other known safety caps are taught by U.S. Pat. No. 5,147,053 to Friedenthal, U.S. Pat. No. 4,998,632 to Morris, Sr., U.S. Pat. No. 4,787,525 to Joyce, U.S. Pat. No. 4,337,869 to Guinle, and U.S. Pat. No. 3,794,200 to Marks, the teachings of all of which are also incorporated by reference herein.

Peterson provides a two-piece safety cap having a spring biasing member disposed in between the outer and inner pieces. The biasing member pushes the outer piece away from the inner piece and allows the outer piece to rotate freely on the container while the inner piece remains fixed and closed. In order to open the container, a person must exert a downward force on the outer piece and thereby push it into engagement with the inner piece. The outer and inner pieces are provided with tongues and grooves, respectively. When the outer piece is pushed into contact with the inner piece, the tongues on the inner surface of the outer piece lock into the grooves formed on the outer surface of the inner piece. When the tongues and grooves are locked together, the two cap pieces may be rotated together, and the medicine container may thus be opened.

Another conventional two-piece safety cap eliminates the need for a spring biasing member interposed between the outer and inner caps. The top surface of the inner cap is provided with ramped risers and the bottom surface of the outer cap is provided with downwardly projecting elements for engaging the ramped risers. Because the top surfaces of the risers are ramped, the projecting elements will slide off of the tops of the ramped risers unless the user exerts significant downward force on the outer cap, thereby squeezing the downwardly projecting elements into frictional engagement with the ramped risers. One of the sides of the riser is made substantially vertical, so that the two caps will move together in one direction (e.g., clockwise or the closing direction) but not the other direction (e.g., counterclockwise or the opening direction).

There are several drawbacks to the abovementioned safety cap. First, not only does it prevent children from obtaining unauthorized access to medication, the conventional safety cap often prevents adults from easily accessing the same medication. Many adults, especially the elderly or the infirm, have a difficult time of exerting the requisite amount of downward force on the outer cap piece to bring the two pieces into locking engagement and, simultaneously, twist the cap off of the container. Also, some adults lack the necessary coordination to perform both the downward pressing and the rotating motions at the same time. Further, the instructions for how to remove such a cap are generally printed on the cap itself; an illiterate, learning disabled, or visually impaired adult may not, absent assistance, be able to open the container.

For adults such as these, it is generally easier to request a non-safety cap when receiving a prescription from a pharmacy. However, with over-the-counter medications, such an option is not always available. Also, while a non-safety cap may be easier to open, it does not prevent children from accessing medication and either ingesting it or wasting it.

Finally, some adults simply do not like the inconvenience of having to struggle with a safety cap, especially if there are no children residing with them or having access to their medicine cabinets. However, it is not inconceivable that children may arrive into these adults' lives, either by being born or merely by visiting. If this occurs, the adults have a responsibility to change the non-safety caps on their medication to safety caps.

SUMMARY OF THE INVENTION

Accordingly, it is an object of the invention to provide a safety cap that facilitates the changeover from a non-safety cap to a safety cap.

It is another object of the invention to provide a safety cap which visually or graphically indicates whether or not it is a safety cap.

It is another object of the invention to provide a cap for medication or the like which can be converted from an ordinary cap to a safety cap.

It is another object of the invention to provide a new and improved safety cap for containers.

The above and other objects are fulfilled by the invention which is a safety cap having an inner cap for covering a container and an outer cap covering the inner cap for selectively rendering the inner cap child resistant. The inventive safety cap further includes a fixing mechanism for selectively fixing the inner and outer caps together, the fixing mechanism being preferably movable from a first position to a second position. When the fixing mechanism is in the first position, the outer cap is rotationally fixed with respect to the inner cap, and when the fixing mechanism is in the second position, the outer cap is rotationally independent of the inner cap. Thus, when the fixing mechanism is in the first position, the inventive cap functions like a conventional non-safety cap. When the fixing mechanism is moved into its second position, the outer and inner caps are made rotationally independent, and thus the cap of the invention functions like a safety cap requiring simultaneous application of downward force and twisting force to remove.

In a preferred embodiment, the outer cap has a bore formed therethrough and the inner cap is disposed in a nesting arrangement with the outer cap. The inner cap member preferably has an upper surface and a pin protruding up from the upper surface and through the bore in the outer cap. The fixing mechanism preferably includes a switch, disposed on the outer cap, engageable with the pin and movable from a first position to a second position. When the switch is in the first position, the switch engages the pin, and when the switch is in the second position, the switch releases the pin. When the pin is engaged by the switch, the inner and outer caps are locked together and rotate as one cap, i.e., a non-safety cap.

In a preferred embodiment, the switch can be moved from the first position to the second position, but the switch cannot be moved from the second position to the first position. That is, once the inventive cap is switched from the conventional to the safety configuration, in a preferred embodiment, it cannot be made a conventional non-safety cap again. The invention also contemplates a cap which can be switched back and forth from safety to non-safety settings.

In a preferred embodiment, the switch includes a bottom surface having an aperture, and the aperture includes a narrow end and a wide end. When the switch is in the first position, the pin is disposed in the narrow end and the switch engages the pin, pulling the two cap members together. When the switch is in the second position, the pin is disposed in the wide end, and the switch releases the pin, thereby allowing the inner and outer cap members to move out of engagement with one another. In the further preferred "irreversible" embodiment, the aperture in the switch includes a tapered necked-down portion between the wide and narrow ends. The necked-down portion allows the pin to be moved from the narrow end to the wide end when the switch is moved from the first position to the second position, but the pin cannot be moved from the wide end to the narrow end.

BRIEF DESCRIPTION OF THE DRAWINGS

FIG. 1A is a top plan view of a safety cap according to the invention.

FIG. 1B is a side view of the safety cap of FIG. 1A.

FIG. 2A is a top plan view of an outer cap member for a safety cap according to the invention.

FIG. 2B is a side view of the outer cap member of FIG. 2A.

FIG. 3A is a top plan view of a button component for a safety cap according to the invention.

FIG. 3B is a side view of the button component of FIG. 3A.

FIG. 3C is a front plan view of the button component of FIG. 3A.

FIG. 3D is a bottom plan view of the button component of FIG. 3A.

FIG. 4A is a side view of an inner cap member for a safety cap according to the invention.

FIG. 4B is a top view of the inner cap member of FIG. 4A.

FIG. 5 is a sectional view of an assembled safety cap according to the invention in a non-safety configuration.

FIG. 6 is a schematic view of the aperture formed in the bottom of the switch shown in FIG. 3.

FIG. 7 is a schematic side view of a raised landing formed on the top surface of the inner cap.

DETAILED DESCRIPTION OF THE PREFERRED EMBODIMENTS

Description of the invention will now be given with reference to FIGS. 1–7. The inventive safety cap 5 includes outer cap member 10 and inner cap member 30 nestled inside outer cap member 10. Inner and outer cap members 10 and 30 are preferably cylindrical or disc-like in shape; however, the invention contemplates any convenient geometry of cap known in the art. Slot 12 is formed on a top portion of outer cap member 10 and is provided with channels 16. Disposed in slot 12 is the switch 20 for changing cap 5 from a non-safety cap to a safety cap. Switch 20 includes button 21 and platform 26. Button 21 sits atop platform 26 and enables the user to select the safety or non-safety configuration, as will be explained below. The sides of platform 26 which extend beyond button 21 fit into channels 16 of slot 12. Switch 20 is slidably mounted in slot 12. One or more raised ridges (not shown) may be provided in slot 12 to limit the range of motion of switch 20 and prevent it from sliding all the way out of slot 12.

An elongated or oval hole or bore 18 is disposed in a preferably central location in slot 12. Bore 18 is adapted to receive connecting structures projecting upwards from inner cap member 30, as will be explained below. Aperture 22 in the bottom of button 21 is also adapted to receive connecting structures projecting upwards from inner cap member 30. Aperture 22 has a wide end 23 and a narrow end 24. Preferably, as shown in FIGS. 3D and 6, a tapered neck is formed between wide end 23 and narrow end 24 by protrusions 25. Each of protrusions 25 preferably has a ramp surface 25-1 and a flat surface 25-2 (see FIG. 6).

Teeth 13 project from an inner surface of outer cap member 10. As shown in FIG. 5, for example, teeth 13 may preferably project radially from the inner side surface 10-1 of outer cap member 10. However, it is also contemplated that teeth 13 may be formed on horizontal inner surface 10-2 and project downwardly instead. A stop ring 11 is formed on and projects radially inwardly from the inner side surface 10-1. Stop ring 11 helps keep the outer and inner cap members 10 and 30 together.

Inner cap member 30 is the part of the safety cap designed to contact the opening of a medicine container or the like. As such, inner cap member 30 is provided with threads 34 on an interior surface thereof. On a periphery of an upper surface of the inner cap member (see FIG. 4B) are provided raised landings 33. Landings 33 and teeth 13 function to meshingly engage one another so that, when outer cap member 10 is rotated, inner cap member 30 is rotated along with it. Preferably, raised landings 33 have a ramped top surface 33-1 (see FIG. 7) which tends to prevent teeth 13 from engaging the landings in a counterclockwise direction. If outer cap member 10 is rotated counterclockwise (i.e., to open the cap), without the application of downward force, teeth 13 will slide along top ramped surfaces 33-1 of raised landings 33 in the direction of arrow B without engaging landings 33. If downward force is applied, teeth 13 are pressed into ramped surfaces 33-1, the teeth and landings frictionally engage one another, and the inner and outer cap members move together. By contrast, when outer cap member 10 is rotated clockwise (i.e., to close the cap), teeth 19 cleanly engage vertical surfaces 33-2 of landings 33 in the direction of arrow C; the inner and outer cap members will close together, with or without the application of downward force.

Projecting up from the upper surface of inner cap member 30 is a protuberance or pin 32. Pin 32 preferably includes a shaft 32-1 fixed to the upper surface of inner cap member 30 and a head 32-2 disposed on the free end of shaft 32-1. Head 32-2 is significantly wider than shaft 32-1 and is preferably formed with a flat bottom surface which extends beyond the profile of shaft 32-1. Pin 32 is positioned to project up into aperture 22 of button 20 and elongated bore 18 of outer cap member 10.

Shaft 32-1 is sufficiently narrow to fit in either the narrow end 24 or the wide end 23 of aperture 22. However, head 32-2 is dimensioned so as to only fit in the wide end 23 of aperture 22. When pin 32 is projecting into narrow end 24, head 32-2 sits on top of the plane of aperture 25 because it cannot fit through narrow end 24. In other words, 20 when pin 32 is projecting into narrow end 24, switch 20 engages pin 32 at the flat bottom surface of head 32-2.

This is significant because, if switch 20 is engaging pin 32 (that is, if head 32-2 is essentially trapped inside switch 20 because narrow end 24 is narrower than the width of head 32-2), then switch 20 is also pulling the entire inner cap member 30 up into contact with outer cap member 10, as shown in FIG. 5, for example. By pulling the outer and inner cap members 10 and 30 into contact, thereby putting teeth 13 and landings 33 in meshing engagement, switch 20 makes the outer and inner cap members 10 and 30 rotationally fixed with respect to one another; if the outer cap member is rotated in this condition, the inner cap member rotates as well. Thus, when switch 20 is in a position or configuration where pin 32 is disposed in the narrow end 24 of aperture 22, safety cap 5 is in a non-safety configuration because the outer and inner cap members 10 and 30 will rotate together and not require a downward pressing force to enable access to the container.

The inventive safety cap 5 may be easily converted from its non-safety configuration to its safety configuration merely by sliding switch 20 along slot 12 until pin 32 is pushed into the wide end 23 of aperture 22. When pin 32 is moved into wide end 23, switch 20 can no longer retain or engage head 32-2 of pin 32, because wide end 23 is dimensioned wider than head 32-2. As a result, head 32-2 falls through aperture 22 (at least part of the way), and teeth 13 of outer cap member 10 will ride on top of raised landings 33 of inner cap member 30 unless downward force is applied to push the teeth and landings into frictional engagement. Thus, when pin 32 is moved into wide end 23, the inventive safety cap is switched into its safety configuration, i.e., teeth 13 and landings 33 are brought out of engagement, and the outer cap member 10 rotates independently of inner cap member 30. Put another way, when switch 20 moves the wide end 23 of aperture 22 into alignment with pin 32, the inventive cap is made child-resistant.

A visual indicator 14 is preferably placed in slot 12 adjacent to switch 20 for indicating the current configuration of the safety cap. For example, when switch 20 is set in the child-resistant position (i.e., with the wide end 23 of aperture 22 aligned with pin 32), platform 26 can reveal a green square to indicate that the container is safe, or the word "OK", or the like, as shown in FIG. 1A. However, if switch 20 is set in the non-safety position, the green square or "OK" will be covered by platform 26 and a red square or the word "DANGER" (not shown) will appear next to switch 20 on the other side of switch 20.

In a preferred embodiment, the inventive safety cap also includes the feature of being able to be changed from the non-safety configuration to the safety configuration but not the other way around, i.e., that the setting of the cap in a safety setting is irreversible. This is accomplished by the provision of protrusions 25 in between the wide end 23 and the narrow end 24 of aperture 22. As mentioned above, protrusions 25 form a necked-down taper in between the two ends of the aperture and are provided with a ramp surface 25-1 and a flat surface 25-2. The ramp surfaces 25-1 allow shaft 32-1 of pin 32 to pass from narrow end 24 to wide end 23 of aperture 22. However, the flat surfaces 25-2 prevent the pin 32 from returning to narrow end 24. The protrusions 25 can be made slightly flexible to allow passage of pin 32 from narrow end 24 to wide end 23.

The components of the safety cap are predominantly made of plastic. Pin 32 may be designed so as to break off at its base if a consumer attempts to force switch 20 from the second child-resistant position to the first non-safety position; that is, the exertion required to force pin 32 back past protrusions 25 into narrow end 24 from wide end 23 would instead snap the pin.

In operation, the invention works as follows. When a consumer purchases medication, it comes in a container with the inventive safety cap 5 affixed thereon. The cap 5 may begin in the non-safety configuration, i.e., with switch 20 covering up the "OK" indicator and showing the "DANGER" indicator, for example. In this configuration, pin 32 is disposed in narrow end 24 of aperture 22, and the outer and inner cap members 10 and 30 are rotationally fixed with respect to one another, owing to the meshing engagement of teeth 13 and landings 33. If the consumer wishes to render the cap child-resistant, he merely slides switch 20 to cover the "DANGER" indicator and uncover the "OK" indicator. By so doing, he moves the wide end 23 of aperture 22 into alignment with pin 32; switch 20 ceases to engage pin 32, and outer and inner cap members 10 and 30 move apart. Teeth 13 are moved out of meshing engagement with raised landings 33, and the outer cap member 10 is free to rotate independently of inner cap 30; that is, if outer cap member 10 is rotated, inner cap member 30 does not rotate, and access to the medication inside the container is denied. In order to remove safety cap 5 from the container, downward force on outer cap member 10 must be applied to push teeth 13 into frictional engagement with ramp surfaces 33-1 of raised landings 33. The inner and outer cap members are thus fixed together, and cap 5 may be removed. However, once switch 20 is flipped into the safety position, it may not be returned to the non-safety position. In either position of the switch, the inner and outer cap members will move together when the cap is rotated clockwise to close the cap.

Having described the invention with respect to the attached drawings and the preferred embodiments, it is to be understood that the invention is not so limited. Rather, the invention is defined by the claims appearing hereinbelow, and modifications to the above description are well within the scope of the contemplated invention. For example, the drawings show and the description above discusses an inner cap member having female threads formed on an inner surface thereof to engage male threads formed on the outer surface of a container. However, the invention also includes a safety cap having an inner cap member with male threads adapted to engage female threads on a container. In that type of arrangement, the rim of the container may fit between the inner and outer cap members. Also, the description and drawings mention a printed visual indicator in the form of the words "OK", "DANGER", a red or green square, etc. However, a raised indicator may also be provided for the visually impaired.

Moreover, as shown in FIG. 5, the invention may include a spring member 40 mounted underneath the outer cap member 10. Spring member 40 may be fixed to the underside of the outer cap member directly beneath slot 12, however it may be mounted in any other convenient location between outer cap member 10 and inner cap member 30. Spring member 40 serves to exert a biasing force against outer and inner cap members 10 and 30 to urge them apart from one another. Put another way, when inner cap member 30 is secured to a container, spring member 40 tends to urge outer cap member upwards in the direction of arrow A of FIG. 5. Spring member 40 preferably includes a main toroidal body 42 and a biasing portion 44. Biasing portion 44 may include a number of legs extending radially from the bottom of toroidal body 42, or biasing portion 44 may include a flexible leaf spring ring. The invention is not limited to these two types of spring members but contemplates any type of biasing structure that is known and used in the safety cap art to maintain distance between outer and inner caps. The spring member may be made of plastic or any other material suitable for biasing, e.g., an elastic metal.

The invention is also not limited to the precise configuration of teeth 13 and landings 33 shown in the figures and described above. Rather, the invention contemplates any and all types of mating lugs, tongues and grooves, gearteeth, etc. that can be or have been used in the art.

What is claimed is:

1. A safety cap, comprising:

an outer cap member having a bore formed therethrough;

an inner cap member disposed in a nesting arrangement with said outer cap member, said inner cap member having an upper surface and a pin protruding up from said upper surface and through said bore in said outer cap member; and a switch, disposed on said outer cap member, engageable with said pin and movable from a first position to a second position, wherein when said switch is in said first position, said switch engages said pin, and when said switch is in said second position, said switch releases said pin.

2. A safety cap according to claim 1, wherein when said switch is in said first position, said outer cap member is rotationally fixed with respect to said inner cap member, and when said switch is in said second position, said outer cap member is rotationally independent with respect to said inner cap member.

3. A safety cap according to claim 1, said outer cap member further comprising a slot formed therein, wherein said switch is slidably disposed in said slot.

4. A safety cap according to claim 1, said inner cap member further comprising threads formed on an internal surface of said inner cap member, said threads being engageable with external threads on a container.

5. A safety cap according to claim 1, said inner cap member further comprising threads formed on an external surface of said inner cap member, said threads being meshingly engageable with internal threads on a container.

6. A safety cap according to claim 1, wherein said switch can be moved from said first position to said second position but said switch cannot be moved from said second position to said first position.

7. A safety cap according to claim 1, further comprising at least one visual indicator disposed on said outer cap member for visually indicating in which of said first and second positions said switch is located.

8. A safety cap according to claim 1, further comprising at least one visual indicator disposed on said outer cap member and coverable by said switch when said switch is in one of said first and second positions.

9. A safety cap according to claim 1, further comprising a spring member disposed between said outer cap member and said inner cap member, wherein said spring member exerts a biasing force between said outer and inner cap members thereby spacing said outer and inner cap members apart when said switch is in said second position.

10. A safety cap according to claim 1, said switch comprising a bottom surface having an aperture, said aperture having a narrow end and a wide end, wherein when said switch is in said first position, said pin is disposed in said narrow end and when said switch is in said second position, said pin in disposed in said wide end.

11. A safety cap according to claim 10, said pin further comprising a shaft extending from said upper surface of said inner cap member and a head disposed on a free end of said shaft, said head having a bottom surface and a width greater than a width of said shaft, wherein when said switch is in said first position, said bottom surface of said head engages said switch around said narrow end of said aperture.

12. A safety cap according to claim 10, said aperture further comprising a tapered necked-down portion between said wide and narrow ends, wherein said pin can be moved from said narrow end to said wide end when said switch is moved from said first position to said second position, but said pin cannot be moved from said wide end to said narrow end.

13. A safety cap according to claim 12, further comprising protrusions formed between said wide and narrow ends on opposite sides of said necked-down portion and having a narrow end side and a wide end side, said protrusions each having a ramp surface on said narrow end side and a flat surface on said wide end side.

14. A safety cap according to claim 13, wherein said ramp surfaces enable said pin to pass from said narrow end to said wide end, and said flat surfaces prevent said pin from passing from said wide end to said narrow end.

15. A safety cap according to claim 1, said outer cap member further comprising teeth formed on an interior surface of said outer cap member, said inner cap member further comprising raised landings formed on a periphery of said of said upper surface of said inner cap member, said teeth and said landings being engaged when said switch is in said first position to rotationally fix said outer cap member to said inner cap member.

16. A safety cap according to claim 15, said landings each comprising a ramped top surface, wherein when said switch is in said first position, said teeth frictionally engage said ramped top surfaces, and when said switch is in said second position, said teeth slide over and do not engage said ramped top surfaces when said outer cap member is rotated counterclockwise.

17. A safety cap according to claim 15, said landings each comprising vertical surfaces, wherein when said outer cap member is rotated clockwise, said teeth engage said vertical surfaces.

18. A safety cap according to claim 15 wherein when said switch is in said second position, said teeth ride over and do not engage said landings.

19. A safety cap according to claim 18, wherein when said switch is in said second position, said teeth and said landings are engageable by application of downward force on said outer cap member to cause frictional engagement between said teeth and said raised landings.

* * * * *